2/25/80 XR 4,190,404

United States Patent [19]

Drs et al.

[11] 4,190,404

[45] Feb. 26, 1980

[54] METHOD AND APPARATUS FOR REMOVING INCLUSION CONTAMINANTS FROM METALS AND ALLOYS

[75] Inventors: Kenneth E. Drs, Collinsville; Sebastian J. Salafia, Middletown; Lee F. Schulmeister, Tolland, all of Conn.

[73] Assignee: United Technologies Corporation, Hartford, Conn.

[21] Appl. No.: 860,521

[22] Filed: Dec. 14, 1977

[51] Int. Cl.[2] ..... B22D 27/02; B22D 1/00; B22D 23/08

[52] U.S. Cl. ..... 425/8; 164/50; 164/134; 164/250; 164/48; 164/DIG. 5; 75/65 EB; 219/121 EB

[58] Field of Search ..... 164/DIG. 5, 134, 48, 164/49, 250, 251, 50; 219/121 EB, 121 EM; 75/65 EB, 65 ZM; 425/8

[56] References Cited

U.S. PATENT DOCUMENTS

| | | | |
|---|---|---|---|
| 3,342,250 | 9/1967 | Treppschuh et al. | 164/250 |
| 3,343,828 | 9/1967 | Hunt | 219/121 EB |

OTHER PUBLICATIONS

"The German Printed Publication" No. 2,206,368, Aug. 73.

*Primary Examiner*—Robert D. Baldwin
*Assistant Examiner*—K. Y. Lin
*Attorney, Agent, or Firm*—Edward J. Timmer; Charles G. Nessler

[57] ABSTRACT

Nonmetallic inclusions and like contaminants are removed from a metal charge by melting the charge to form a molten pool on which the inclusion contaminants float and directing an electron beam onto a preselected first portion of the pool surface, said selective beam impingement causing the floating contaminants to segregate to other portion not subjected to beam impingement. Removal of molten metal from the impinged surface portion while the inclusion contaminants are confined elsewhere on the pool surface provides a clean molten metal product. Apparatus for use with the process is also disclosed. The invention finds special application in the master melting or remelting of metals and alloys for conversion to ingot shapes or high purity molten metal for powder making, investment casting, forging and the like.

6 Claims, 3 Drawing Figures

FIG. 1
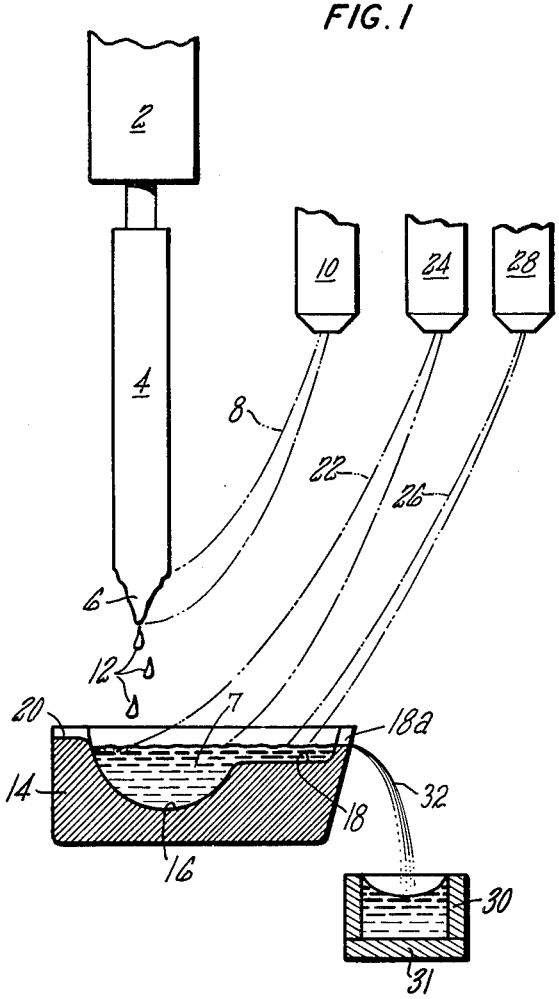
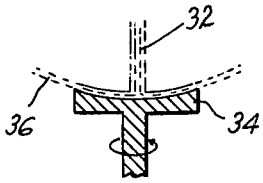
FIG. 3
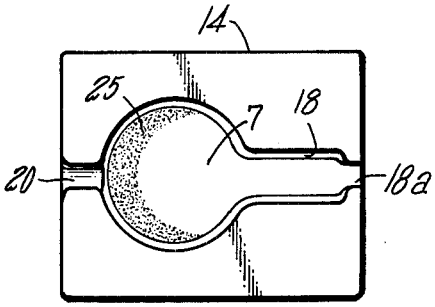
FIG. 2

METHOD AND APPARATUS FOR REMOVING INCLUSION CONTAMINANTS FROM METALS AND ALLOYS

BACKGROUND OF THE INVENTION

1. Field of the Invention

The present invention relates to metal purification and, more particularly, to means for removing nonmetallic inclusions and like foreign matter from metals and alloys.

2. Description of the Prior Art

Gas turbine engine components are subjected to severe conditions of service, for example, high temperatures, high stresses and corrosive atmospheres. As a result, it is desirable to fabricate such components from the cleanest available metals and alloys. It is especially important to utilize metals and alloys having minimum levels of nonmetallic inclusions, such as $SiO_2$, $Al_2O_3$, MgO, etc., which adversely affect the mechanical properties of the material. To this end, various techniques have been utilized in the past to insure metal cleanliness, for example, vacuum induction melting, vacuum arc remelting and electroslag remelting have been employed in converting alloys into ingots for forging, powder making and investment casting. However, these techniques have produced less than satisfactory results, in some cases increases in the incidence of foreign inclusion contamination actually being observed.

SUMMARY OF THE INVENTION

Accordingly, the present invention provides means for removing nonmetallic inclusions and like contamination from metals and alloys, the invention being especially useful in the master melting or remelting of such materials for conversion into ingot shapes or a high purity molten product for forging, powder making, casting and other metallurgical processing.

Typically, the method of the invention includes the steps of (a) melting the metal charge to be cleaned to form a molten pool, any inclusions present in the charge tending to float on the pool surface as a result of density differentials, (b) directing an electron beam onto a preselected first portion of the pool surface, impingement of the beam causing the floating inclusions to segregate to other portions not impinged by the beam and (c) removing clean molten metal from the preselected, impinged surface area while the inclusions are segregated elsewhere on the pool surface.

In a particularly preferred embodiment of the invention, a master ingot containing inclusion contaminants is drip melted into a specially configured copper crucible by passing a first electron beam over the tip of the ingot. The molten metal drips from the ingot tip and falls into the crucible which includes a central metal droplet receiving chamber, generally hemispherical in shape, and shallow, elongated channels communicating with opposite sides of the chamber for removing clean molten metal on one side and segregated inclusion contaminants on the other. Preferably, the metal discharge channel is deeper than the inclusion discharge channel so that only clean molten metal flows out of the crucible as it is filled by the dripping melt. As the molten metal drips from the ingot tip and is collected in the chamber to form a molten pool, a skull or thin solidified metal layer is formed between the crucible and pool, preventing contamination of the melt. A second electron beam is directed onto that portion of the pool surface which is adjacent and in proximity to the clean metal discharge channel to not only heat the pool to maintain its molten condition but also to cause the floating inclusions to segregate to the nonimpinged surface areas adjacent the inclusion discharge channel. When the molten metal rises to the pour point, that is, when the metal discharge channel is filled, a third electron beam can be directed onto the clean metal in the channel for temperature control purposes. From the discharge channel, the clean molten metal can be discharged into conventional ingot molds, complex casting molds, powder making devices and the like. Removal of the inclusion contaminants from the crucible can be achieved by tilting the crucible downwardly on the side of the inclusion discharge channel to cause flow of the dirty metal therethrough.

These and other details, advantages and objects of the present invention will become more fully apparent from the following drawings and detailed description of preferred embodiments.

DESCRIPTION OF THE DRAWINGS

FIG. 1 is a schematic illustration of apparatus for use in the electron beam ingot refining process of the invention.

FIG. 2 is a top view of the crucible shown in FIG. 1.

FIG. 3 is a schematic illustration of apparatus for powder making.

DESCRIPTION OF PREFERRED EMBODIMENTS

FIG. 1 illustrates in schematic fashion typical apparatus employed in the preferred electron beam refining process of the invention. The apparatus typically comprises a feeding mechanism 2 of well known construction for advancing a master ingot 4 for drip melting by electron beam impingement of the tip 6 thereof. Master ingot 4 generally is cylindrical in shape and can be made by various conventional techniques including, but not limited to, vacuum induction melting and vacuum arc remelting. However, master ingots made by these and other techniques usually contain characteristic amounts of nonmetallic inclusions and similar contaminants which are not desired in the final product. For example, a master ingot of an alloy commonly known as modified IN 100 (nominal composition by weight being 12.4% Cr-18.5% Co-3.3% Mo-5.0% Al-4.4% Ti-1.7% Cb-0.8% Hf-0.02% C balance essentially Ni) made by vacuum induction melting ordinarily contains nonmetallic inclusions in the form of oxide particles of $Al_2O_3$, $HfO_2$, etc. In making alloy parts to be subjected to high temperatures and stresses, for example, gas turbine engine components such as blades and vanes, it is critical that these inclusion contaminants be minimized in the alloy product.

According to the present invention, the tip 6 of the master ingot is drip melted by impinging the tip with an electron beam 8 generated by electron gun 10. Of course, suitable deflection devices such as magnets are provided to focus and direct the electron beam onto the ingot tip. These devices as well as the electron gun 10 are well known in the art, for example, an electron gun workable in the process of the invention is sold and manufactured by Leybold-Heraeus. The power of the electron gun utilized can of course be varied depending upon the type of metal or alloy ingot being melted.

The molten drops 12 generated by the drip melting process fall downwardly into a water cooled copper crucible 14. More specifically, the copper crucible includes a central metal droplet receiving chamber 16, generally hemispherical in shape, into which the molten droplets fall from ingot tip 6 to form molten pool 7. The volume of chamber 16 of course can be varied to suit particular production applications, larger chambers being used when greater capacity is required. As shown in FIGS. 1 and 2, an elongated metal discharge channel 18 having pouring spout 18*a* and elongated inclusion discharge channel 20 are positioned and in communication with the chamber on opposite sides thereof. As can be seen, the metal discharge channel and pour spout have greater depths than channel 20 so that, as the crucible fills, molten metal will be discharged from only pour spout 18*a*.

An important feature of the present invention includes the use of a second electron beam 22 from electron gun 24 to not only maintain pool 7 in the molten condition but also cause the floating inclusion contaminants 25 to segregate to the pool surface adjacent the inclusion discharge channel 20, FIG. 2. The use of the electron beam for this purpose resulted from the discovery that the floating inclusion contaminants exhibit a definite tendency to segregate to areas of the pool surface which are not being subjected to electron beam impingement. Thus, to achieve the segregation shown in FIG. 2, the electron beam 22 is directed onto that portion of the pool surface which is adjacent the metal discharge channel 18. This selective beam impingement causes the inclusions to congregate on that portion of the pool surface adjacent the inclusion discharge channel 20 where they can be subsequently removed. With conventional focusing and deflection means, such as electromagnetic devices, the impingement area of electron beam 22 can be varied as desired to achieve the required segregation. While the inclusion contaminants are thus segregated, clean molten metal is removed via channel 18 and pour spout 18*a*, as a continuous or discontinuous stream 32. Removal of metal can be effected by tilting the crucible to lower the pour spout or merely by overflow as the crucible fills with the molten metal droplets. To maintain the clean molten metal in channel 18 at the desired temperature for transfer, a third electron beam 26 from electron gun 28 is directed onto the surface of the metal in the channel. In this way, the exact molten metal temperature for casting or powder making can be provided. Removal of the inclusion contaminants can be conducted periodically during refining or at the termination thereof. A convenient technique for removing the contaminants is to tilt the crucible to lower discharge channel 20 and cause dirty molten metal to flow out into a suitable slag vessel.

As shown, the clean molten metal is discharged from the crucible through pour spout 18*a* and falls directly into ingot mold 30 resting on stool 31 for solidification into ingot stock for forging, powder making, investment casting and the like. Alternatively, the clean molten metal can be discharged into dynamic metallurgical machinery, for example, a cooled rotating disc 34 could be substituted for the mold 30 of FIG. 1 and the molten metal allowed to fall directly onto the rotating disc to make droplets which solidify into quantities of clean metal powder 36. Of course, such powder making apparatus is usually enclosed within a suitable vacuum chamber to minimize gaseous impurities. The apparatus of the invention can be readily housed in such an enclosure.

The effectiveness of the present invention in removing nonmetallic inclusions has been illustrated with respect to the modified IN 100 alloy described hereinbefore. An ingot of the alloy as melted in vacuum into a water cooled copper crucible using two electron beams impinging upon the ingot tip. The melted charge was slowly poured from the crucible into an ingot mold. During the pour, one of the electron beams used for melting was repositioned on the surface of the molten pool in the crucible, the beam impingement area being directly in front of or adjacent the crucible pour spout. The selective beam impingement caused most of the floating inclusions to be segregated away from the impinged area in pool surfaces remote from the pour spout. The majority of the ingot produced in the ingot mold was virtually inclusion free upon inspection. Only a few inclusions were present in the ingot and they were confined to the very top portion. These inclusions could have been eliminated from the ingot with better control over pouring.

It will be apparent that the present invention can be utilized in the master melting as well as remelting of metals and alloys for removal of inclusion contaminants. A wide variety of metals and alloys can be cleaned by the present invention, in vacuum if desired. Those skilled in the art will recognize that it may be possible to use other crucible and electron beam configurations to achieve the purposes and objects of the invention. Also, melting processes other than drip melting by electron beam impingement may be employed to form the molten metal or alloy pool. Of course, other changes, additions, and omissions in the form and detail of the preferred embodiments can be made without departing from the spirit and scope of the invention.

Having thus described a typical embodiment of our invention, that which we claim as new and desire to secure by Letters Patent of the United States is:

1. A method for removing floating nonmetallic inclusions from a molten pool of metal in a crucible using an electron beam, comprising:

(a) impinging an electron beam onto the surface of the molten pool within the crucible;

(b) segregating floating nonmetallic inclusions in a portion of the pool surface by action of the electron beam;

(c) discharging clean molten metal from another portion of the pool surface which is substantially freed of inclusions by the beam action;

(d) preventing inclusions from being removed with the clean molten metal flowing from the crucible by manipulation of the beam impingement pattern on the pool surface.

2. The method of claim 1 wherein unclean metal is continuously added to the crucible and clean molten metal is discharged by overflow of molten metal from the crucible at a discharge channel.

3. The method of claim 1 comprising the further step of controlling the temperature of molten metal being discharged by impingement of an electron beam thereon.

4. Apparatus useful for removing floating nonmetallic inclusions from a molten metal charge, comprising:

(a) a crucible having a chamber for containing a pool of molten metal, a molten metal discharge channel, and an inclusion discharge channel, each channel being in communication with the chamber at diverse points around the periphery of the crucible;

(b) means for introducing metal into the crucible;

(c) means for impinging an electron beam on the surface of a molten pool within the crucible, the beam adapted to maintain metal in the molten state and having an orientation and motion which causes floating inclusions to move toward the inclusion discharge channel;

(d) means for causing molten metal to flow from the crucible through the metal discharge channel;

(e) means for receiving clean metal flowing from the metal discharge channel.

5. Apparatus useful for removing floating nonmetallic inclusions from a molten metal charge, comprising:

(a) a crucible having a chamber for containing a pool of molten metal, a molten metal discharge channel, and an inclusion discharge channel, each channel being in communication with the chamber at diverse points around the periphery of the crucible, and the depth of the inclusion discharge channel being less than the depth of the metal discharge channel;

(b) means for introducing metal into the crucible;

(c) means for impinging an electron beam on the surface of a molten pool within the crucible, the beam adapted to maintain metal in the molten state and having an orientation and motion which causes floating inclusions to move toward the inclusion discharge channel;

(d) means for adding metal to the crucible to cause metal to overflow from the crucible through the metal discharge channel;

(e) means for receiving clean metal flowing from the metal discharge channel.

6. The apparatus of claims 4 or 5 wherein the means for introducing the metal charge includes an electron beam and the means for receiving the clean molten metal is powder making means and further comprising electron beam means for controlling the temperature of clean molten metal flowing in the discharge channel.

* * * * *